United States Patent [19]

Maisch et al.

[11] 4,353,385

[45] Oct. 12, 1982

[54] DIAPHRAGM PRESSURE REGULATOR

[75] Inventors: Wolfgang Maisch, Schwieberdingen; Klaus-Jürgen Peters, Affalterbach; Michael Wissmann, Gerlingen; Karl Gmelin, Ingelfingen, all of Fed. Rep. of Germany

[73] Assignee: Robert Bosch GmbH, Stuttgart, Fed. Rep. of Germany

[21] Appl. No.: 236,385

[22] Filed: Feb. 20, 1981

[30] Foreign Application Priority Data

Feb. 22, 1980 [DE] Fed. Rep. of Germany ..... 3006587

[51] Int. Cl.[3] ..... F02M 37/00

[52] U.S. Cl. ..... 137/115; 123/459; 123/511; 137/510

[58] Field of Search ..... 123/457, 459, 511; 137/116, 115, 510

[56] References Cited

U.S. PATENT DOCUMENTS

| | | | |
|---|---|---|---|
| 3,970,063 | 7/1976 | Mayr | 123/459 X |
| 4,018,200 | 6/1979 | Stumpp et al. | 137/454 |
| 4,235,211 | 11/1980 | Sugaya | 123/511 |

*Primary Examiner*—Robert G. Nilson

*Attorney, Agent, or Firm*—Edwin E. Greigg

[57] ABSTRACT

A diaphragm pressure regulator is proposed which serves to regulate a fluid pressure in a system having fluid flowing through it, and in particular to relate the fuel pressure in a fuel injection system. The diaphragm pressure regulator includes a valve diaphragm, which cooperates with a valve seat. The valve diaphragm separates a spring chamber having a system pressure spring from a system pressure chamber, into which the valve seat, which is axially displaceable and is supported in an axial bearing point, protrudes and which communicates with the fluid to be regulated. The end of the valve seat remote from the valve diaphragm is embodied as a valve plate and protrudes into a collection chamber, in which it opens a sealing seat toward a return flow line to a greater or lesser extent. A closing pressure spring engages the valve plate and urges the valve seat in the direction of the valve diaphragm. When the valve diaphragm is lifted up from the valve seat, fluid flows via a conduit in the valve seat into the collection chamber. A throttle gap is provided between the system pressure chamber and the collection chamber, by way of which throttle gap fluid can flow out to the collection chamber, when the fluid system is shut off, until such time as the valve plate is pressed in a sealing fashion against the sealing seat and blocks the return flow line, which takes place below a predetermined fluid pressure.

5 Claims, 1 Drawing Figure

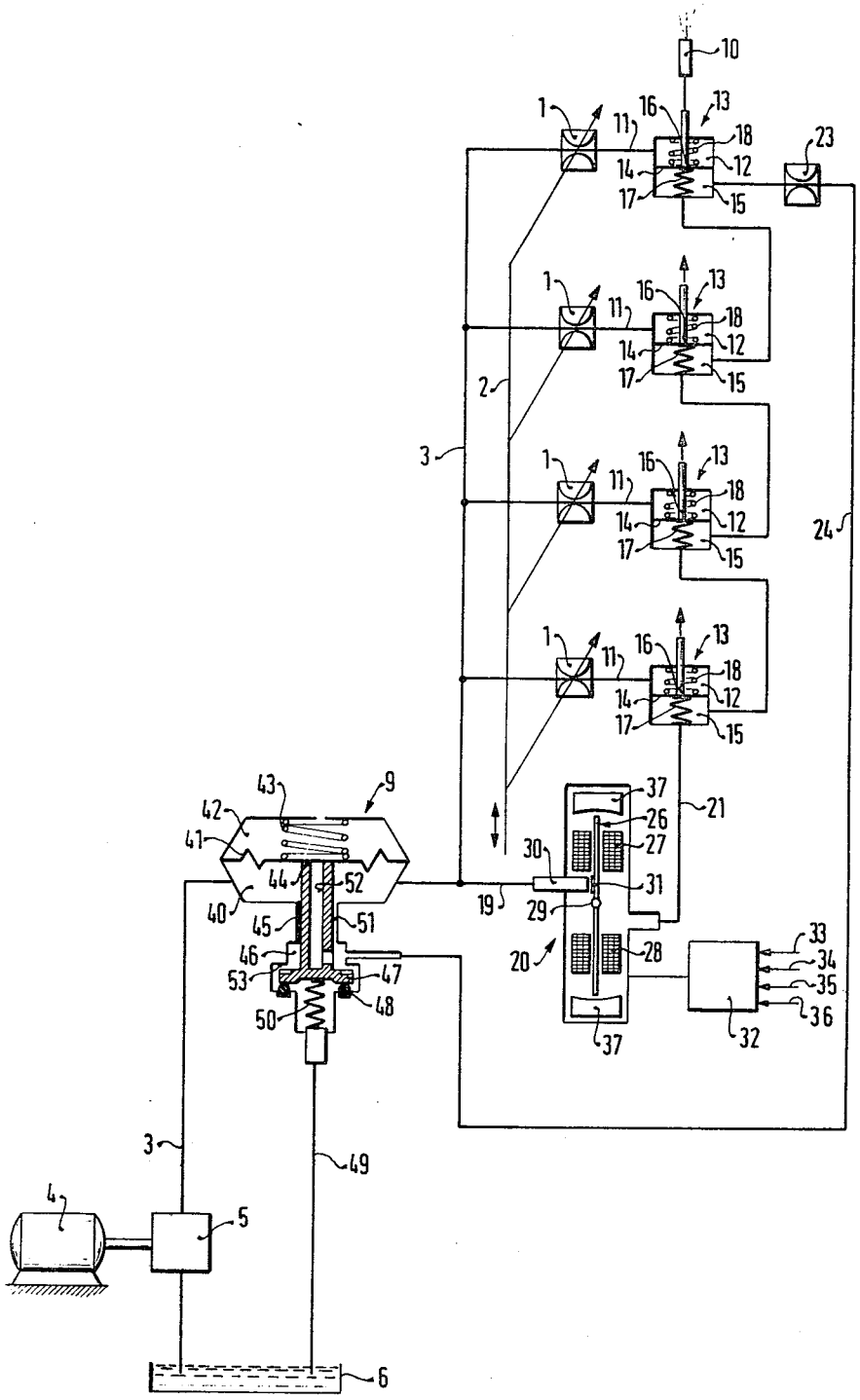
10
1
11
16
13
18
12
14
17
15
23
2
3
24
21
37
26
27
30
31
19
29
20
28
33
34
35
36
32
9
43
42
41
44
52
40
45
51
46
53
47
48
50
49
4
5
6

DIAPHRAGM PRESSURE REGULATOR

BACKGROUND OF THE INVENTION

The invention is based on a diaphragm pressure regulator of the general type described by the preamble to the main claim. A diaphragm pressure regulator for regulating the fluid pressure in a system having fluid flowing through it is already known; this regulator has the disadvantage, however, that in its resting position it no longer seals effectively over the long term, so that fluid can leak out, and the system must first be refilled before operation can begin again, which may cause delays in response time or even functional interruptions.

OBJECTS AND SUMMARY OF THE INVENTION

The diaphragm pressure regulator according to the invention and having the characteristics of the main claim has the advantage over the prior art that the fluid pressure can be regulated very precisely, and when the fluid system is shut off, a reduction of the fluid pressure is first effected below a predetermined fluid pressure, and the fluid system is subsequently tightly blocked with respect to the return flow line, while upon renewed operation of the fluid system a higher pressure is required to open the return flow line, so that reliable closure is assured, even when there has been an intervening warming up of the fluid enclosed in the system and a resultant increase in pressure.

As a result of the characteristics disclosed in the dependent claims, advantageous modifications of and improvements to the diaphragm pressure regulator disclosed in the main claim are attainable.

The invention will be better understood and further objects and advantages thereof will become more apparent from the ensuing detailed description of a preferred embodiment taken in conjunction with the drawing.

BRIEF DESCRIPTION OF THE DRAWING

One exemplary embodiment of the invention is shown in simplified form in the drawing and will be discussed in detail below.

DESCRIPTION OF THE PREFERRED EMBODIMENT

In the exemplary embodiment shown in FIG. 1 of a fuel injection system, metering valves 1 are shown, with one metering valve 1 associated with each cylinder of a mixture-compressing internal combustion engine with externally-supplied ignition, not shown. At these metering valves 1, a quantity of fuel is metered which is in a predetermined ratio to the quantity of air aspirated by the engine. The fuel injection system shown has, by way of example, four metering valves 1 and is thus intended for a four-cylinder engine. The cross section of the metering valves is variable in common, as shown by way of example in the drawing, by means of an actuation element 2 in accordance with operating characteristics of the engine; this variation may, for instance, be made in a known manner in accordance with the quantity of air aspirated by the engine. The metering valves 1 are located in a fuel supply line 3, into which fuel is supplied from a fuel container 6 by a fuel pump 5 driven by an electromotor 4. A diaphragm pressure regulator embodied as a pressure limitation valve 9 is disposed in the fuel supply line 3 and limits the fuel pressure prevailing in the fuel supply line 3, thereby permitting the fuel to flow back into the fuel container 6 if this fuel pressure exceeds a certain desired value.

Downstream of each metering valve 1, a line 11 is provided by way of which the metered fuel proceeds into a regulating chamber 12 of a regulating valve 13, one of which is assigned to each metering valve 1. A regulating chamber 12 of the regulating valve 13 is separated by a movable valve element, embodied by way of example as a diaphragm 14, from a control chamber 15 of the regulating valve 13. The diaphragm 14 of the regulating valve 13 cooperates with a fixed valve seat 16 provided in the regulating chamber 12, by way of which valve seat 16 the metered fuel can flow out of the regulating chamber 12 to the individual injection valves 10, of which only one is shown, in the intake tube of the engine. A differential pressure spring 18 is disposed in the regulating chamber 12, which urges the diaphragm 14 in the opening direction of the regulating valve 13. A closing spring 17 is also disposed in the control chamber 15, its spring force being greater than that of the differential pressure spring 18 and preventing fuel on the one hand, when the engine is shut off from flowing out of the fuel supply line 3 to the injection valves 10 and, on the other hand, enables the adaptation of the quantities of fuel metered at the individual injection valves to one another during idling, for instance.

A line 19 branches off from the fuel supply line 3, discharging into a control pressure line 21 by way of an electro-fluid transformer or converter of the nozzle/-bounce plate type 20. The control chambers 15 of the regulating valve 13 are disposed in the control pressure line 21 downstream of the electro-fluid converter 20, and a control throttle 23 is disposed downstream of the control chambers 15. Fuel can flow out of the control pressure line 21 into an outflow line 24 by way of the control throttle 23. The electro-fluid converter of the nozzle/bounce plate type is known per se and will accordingly be described herein only briefly as to its function and mode of operation. The electro-fluid converter 20 contains a rocker 26, to which a variable deflection moment is imparted electromagnetically by means of coils 27, 28 so that it undergoes a certain deflection about a rotary axis 29. The line 19 discharges at a nozzle 30 in the electro-fluid converter 20, opposite a bounce plate 31 attached to the rocker 26. At a constant deflection moment engaging the rocker 26, a pressure drop is thus created between the nozzle 30 and the bounce plate 31, this pressure drop being large enough so that a constant pressure difference, dependent on the deflection moment, is established between the fuel pressure in the line 19 and the fuel pressure in the control pressure line 21. The electro-fluid converter 20 is triggered by way of an electronic control device 32 in accordance with appropriately furnished operating characteristics of the engine, such as rpm 33, throttle valve position 34, temperature 35, exhaust composition (oxygen sensor) 36 and others. The electro-fluid converter 20 may be triggered by the electronic control device 32 in either analog or clocked fashion. In the non-excited state of the electro-fluid converter 20, a fundamental moment can be brought about, by means of suitable spring forces or permanent magnets 37 on the rocker 26, this fundamental moment being diminished such that a pressure difference is established which assures emergency operation of the engine even in the case of failure of the electrical triggering process.

In the presence of control signals characterizing engine overrunning, such as rpm above the idling rpm and a closed throttle valve, the electro-fluid coverter 20 can be excited in such a manner that the fuel pressure in the control pressure line 20 increases to such an extent that the regulating valves 13 close, thus precluding any injection of fuel via the injection valve 10.

The diaphragm pressure regulator 9 has a system pressure chamber 40, which communicates with the fuel supply line 3 and is separated by a valve diaphragm 41 from a spring chamber 42 which communicates with the atmosphere and in which a system pressure spring 43 is disposed which urges the valve diaphragm 41 in the closing direction of the valve. A valve seat 44 protrudes into the system pressure chamber 40, cooperating with the valve diaphragm 41 and being supported in an axially displaceable manner on an axial bearing point 45. The end of the valve seat remote from the valve diaphragm 41 protrudes at the other end out of axial bearing point 45 into a collection chamber 46 and is embodied as a valve plate 47. The valve plate 47 opens or closes a sealing seat 48, which may be embodied as a rubber ring, by way of which fuel can flow back into a return flow line 49 and from there toward the intake side of the fuel pump 5, for instance toward the fuel container 6. A closing pressure spring 50 is supported on the valve plate 47 and urges the valve plate 47 in the opening direction, having the tendency to displace the valve seat 44 counter to the force exerted upon the valve seat 44 by way of the valve diaphragm 41. A throttle gap 51 is provided in the axial bearing point 45 of the valve seat 44 between the system pressure chamber 40 and the collection chamber 46. All the fuel lines, for instance the discharge line 24 by way of which the fuel is intended to flow back to the fuel container 6, discharge into the collection chamber 46. Thus a conduit 52 is provided in the valve seat 44, by way of which fuel can flow into the collection chamber when the valve diaphragm 41 is raised up from the valve seat 44. The cross section of the valve plate 47 exposed to fuel is smaller than the cross section of diaphragm 41, and the elastic sealing seat 48 has approximately the same cross section as does the valve plate 47.

The function of the diaphragm pressure regulator 9 is as follows:

When the engine is being shut off, the valve plate 47 seats itself on the sealing seat 48 and closes the return flow line 49, while the valve diaphragm 41 closes the valve seat 44. When the engine has started, the fuel pump 5 supplied fuel into the fuel supply line 3 and thus into the system pressure chamber 40 of the pressure limitation valve 9 as well. If this pressure increases above a predetermined opening pressure at which the force of the fuel pressure exerted upon the valve diaphragm 41 and the spring force of the closing pressure spring 50 are greater than the spring force of the system pressure spring 43 and the force of the fuel pressure exerted on the valve plate 47, then the valve plate 47 lifts up from the sealing seat 48, and the valve seat 44 is displaced in the direction of the valve diaphragm 41. This displacement is limited by a stop 53, at which the valve plate 47 comes to rest. Now, if a fuel pressure (system pressure) determined only by the spring force of the system pressure 43 is attained, then the valve diaphragm 41 lifts up from the valve seat 44 and fuel can flow via the conduit 52 into the collection chamber 46 and from there into the return flow line 49. As the engine is being shut off, that is, the fuel supply on the part of the fuel pump 5 is interrupted, the valve diaphragm 41 closes the valve seat 44. The spring forces of the system pressure spring 43 and the closing pressure spring 50 and the cross sections of the valve diaphragm 41 and that of the valve plate 47 exposed to fuel are adapted to one another in such a way that at first fuel can continue to flow by way of the throttle gap 51 into the collection chamber 46 and out of the collection chamber 46 by way of the sealing seat 48 into the return flow line 49, until the fuel pressure in the fuel injection system is lower than the fuel pressure required for opening the injection valves 10. The valve plate 47 is displaced to such an extent, counter to the force of the closing pressure spring 50, that it comes to rest on the sealing seat 48, thereby closing the return flow line 49, only when the fuel pressure is below that required to open the injection valves 10. The valve plate 47 is additionally pressed against the sealing seat 48 by the fuel pressure prevailing in the collection chamber 46. As a result, leakage of fuel out of the fuel injection system is prevented, so that when the engine is started once again the fuel injection system is operational in the shortest possible time. Now, if the engine is started once again, then the required opening pressure, at which the valve plate 47 lifts up from the sealing seat 48, is greater than the pressure required for closing, because in the closed state there is no equalization of forces at the valve plate 47 between the pressure forces brought about in the collection chamber 46 by the fuel pressure. However, an opening pressure increased relative to the closing pressure is desirable in order to assure reliable closing, even if the fuel pressure in the fuel injection system does increase after the engine has been shut off as a result of the warming of the fuel enclosed in the system which then occurs.

The diaphragm pressure regulator 9 according to the invention is usable wherever a very precise regulation of pressure is required and wherever a leakage of the regulated fluid out of the fluid system is to be prevented in the resting position, in which case the fluid pressure required for closing is intended to be lower than the fluid pressure required for opening.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. A diaphragm pressure regulator for regulating the fuel pressure in a fuel injection system, having a movable valve element embodied as a valve diaphragm and a valve seat arranged to cooperate with said valve diaphragm, characterized in that said valve diaphragm separates a spring chamber from a system pressure chamber, said system pressure chamber arranged to communicate with the fluid to be regulated, and said valve diaphragm further arranged to be urged by a system pressure spring disposed in said spring chamber in the direction of said valve seat which protrudes axially and displaceably into said system pressure chamber, said valve seat being supported in an axial bearing point, said valve seat further having an end remote from said valve diaphragm which comprises a valve plate which protrudes into a collection chamber and arranged to open a sealing seat to a greater or lesser extent toward a return flow line, a closing pressure spring positioned beneath said valve plate to urge said valve seat in the direction of said valve diaphragm and against a stop remote from said sealing seat, so that when said valve diaphragm is lifted up from said valve seat fluid can flow out via a conduit into said collection chamber and further wherein a throttle gap is provided between said system pressure chamber and said collection chamber.

2. A diaphragm pressure regulator as defined by claim 1, characterized in that said throttle gap is provided in the axial bearing point of said valve seat.

3. A diaphragm pressure regulator as defined by claim 2, characterized in that said valve plate has a diameter which is smaller than a diameter of said valve diaphragm.

4. A diaphragm pressure regulator as defined by claim 3, characterized in that said sealing seat comprises an elastic ring.

5. A diaphragm pressure regulator as defined by claim 4, characterized in that the spring forces of said system pressure spring and the closing pressure spring and the cross section of said valve diaphragm and of said valve plate are correlated to one another in such a manner that said valve plate comes to rest at said sealing seat, thus blocking said return flow line, only after the fluid pressure is lower than a predetermined quantity.

* * * * *